US009012523B2

(12) United States Patent
Ariyapadi

(10) Patent No.: US 9,012,523 B2
(45) Date of Patent: Apr. 21, 2015

(54) METHANATION OF A SYNGAS

(75) Inventor: Siva Ariyapadi, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 579 days.

(21) Appl. No.: 13/335,314

(22) Filed: Dec. 22, 2011

(65) Prior Publication Data

US 2013/0165535 A1 Jun. 27, 2013

(51) Int. Cl.
*C07C 27/00* (2006.01)
*C10G 2/00* (2006.01)

(52) U.S. Cl.
CPC ..... *C10G 2/32* (2013.01)

(58) Field of Classification Search
CPC ..... C07C 1/04; B01J 7/00
USPC ..... 518/700, 712
See application file for complete search history.

(56) References Cited

U.S. PATENT DOCUMENTS

| | | | | |
|---|---|---|---|---|
| 3,890,113 | A | 6/1975 | Child et al. | |
| 4,177,202 | A | 12/1979 | Chang et al. | |
| 7,247,281 | B2 | 7/2007 | Jahnke et al. | |
| 2005/0226792 | A1 * | 10/2005 | Jahnke et al. | 422/188 |
| 2008/0016756 | A1 | 1/2008 | Pearson | |
| 2009/0247653 | A1 | 10/2009 | Ravikumar et al. | |
| 2009/0264542 | A1 | 10/2009 | Filippi et al. | |
| 2010/0018115 | A1 | 1/2010 | Wallace et al. | |
| 2010/0162627 | A1 | 7/2010 | Clomburg, Jr. et al. | |
| 2010/0286292 | A1 * | 11/2010 | Wix | 518/702 |
| 2011/0137089 | A1 * | 6/2011 | Abbott | 568/840 |

* cited by examiner

*Primary Examiner* — Jafar Parsa
(74) *Attorney, Agent, or Firm* — Gary M. Machetta

(57) ABSTRACT

Systems and methods for producing a synthetic natural gas are provided. A syngas can be separated into a first syngas, a second syngas, and a third syngas. The first syngas can be methanated to produce a first effluent. The first effluent can be mixed with the second syngas to produce a first mixed effluent. The first mixed effluent can be methanated to produce a second effluent. The second mixed effluent can be methanated to produce a third effluent. The third effluent can be cooled to produce a first cooled effluent. The first cooled effluent can be cooled to produce a synthetic natural gas.

17 Claims, 2 Drawing Sheets

METHANATION OF A SYNGAS

BACKGROUND

1. Field

Embodiments described herein generally relate to processing syngas. More particularly, such embodiments relate to systems and methods for the methanation of syngas.

2. Description of the Related Art

Methanation of syngas is a reaction between hydrogen and carbon oxides, specifically, carbon dioxide and carbon monoxide, to form water and methane, which is typically referred to as synthetic or substitute natural gas ("SNG"). SNG can provide a reliable supply of fuel and can be transported from a production location into an already existing natural gas pipeline infrastructure, making the production of SNG economical in areas where it would otherwise be too expensive to mine and transport low grade coal. Alternatively, in developing countries, the production and supply of clean, efficient SNG to densely populated cities, instead of the transportation and use of low grade coal as an energy source in a multitude of inefficient and polluting facilities, can mitigate pollutants and facilitate carbon capture.

Methanation reactions, however, are exothermic and can lead to undesirably high temperatures that can reduce conversion and energy efficiency by causing deactivation of the catalyst. Current methanation processes are also energy inefficient in that a large amount of the heat generated from the methanation reactions is wasted.

There is a need, therefore, for improved systems and methods for producing SNG from a syngas.

DETAILED DESCRIPTION

Systems and methods for producing a synthetic natural gas are provided. A syngas can be separated into a first syngas, a second syngas, and a third syngas. The first syngas can be methanated to produce a first effluent. The first effluent can be mixed with the second syngas to produce a first mixed effluent. The first mixed effluent can be methanated to produce a second effluent. The second effluent can be mixed with the third syngas to produce a second mixed effluent. The second mixed effluent can be methanated to produce a third effluent. The third effluent can be cooled to produce a first cooled effluent. The first cooled effluent can be cooled to produce a synthetic natural gas.

Figure 1:
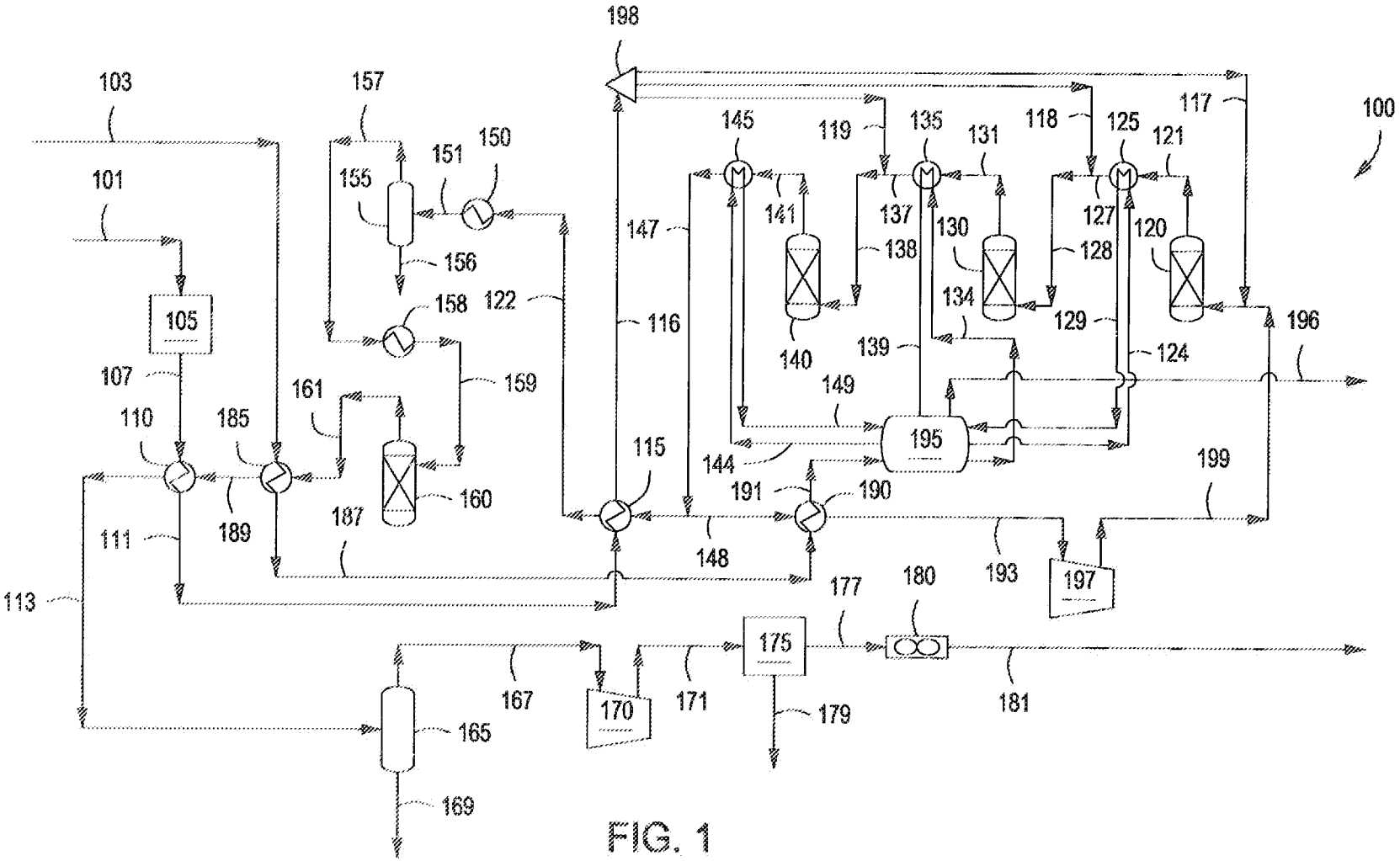
FIG. 1 depicts a schematic of an illustrative methanation system, according to one or more embodiments described.

FIG. 1 depicts a schematic of an illustrative methanation system 100, according to one or more embodiments. The methanation system 100 can include one or more guard beds 103, one or more methanation reactors or methanators (four are shown 120, 130, 140, 160), one or more heat exchangers (ten are shown 110, 115, 125, 135, 145, 150, 138, 180, 185, 190), one or more heat transfer medium collector/separators 195, one or more compressors (two are shown 170, 197), one or more vapor-liquid separators (two are shown 155, 165), one or more driers 175, and one or more manifolds or splitters 198.

A synthesis gas or syngas via line 101 can be introduced to the methanation system 100 to produce a synthetic or substitute natural gas ("SNG") via line 181. The syngas in line 101 can include, but is not limited to, hydrogen, carbon monoxide, carbon dioxide, methane, nitrogen, argon, water, sulfur or sulfur containing compounds, or any combination thereof.

The syngas in line 101 can have a hydrogen concentration ranging from a low of about 20 mol %, about 30 mol %, about 40 mol %, or about 50 mol % to a high of about 60 mol %, about 70 mol %, about 80 mol %, or about 90 mol %, on a dry basis. For example, the syngas in line 101 can have a hydrogen concentration of about 25 mol % to about 83 mol %, about 35 mol % to about 75 mol %, about 45 mol % to about 65 mol %, or about 60 mol % to about 70 mol %, on a dry basis. The syngas in line 101 can have a carbon monoxide concentration ranging from a low of about 1 mol %, about 3 mol %, about 10 mol %, or about 15 mol % to a high of about 23 mol %, about 30 mol %, about 33 mol %, or about 40 mol %, on a dry basis. For example, the syngas in line 101 can have a carbon monoxide concentration of about 3 mol % to about 37 mol %, about 7 mol % to about 33 mol %, about 13 mol % to about 27 mol %, or about 17 mol % to about 23 mol %, on a dr basis. The syngas in line 101 can have a carbon dioxide concentration ranging from a low of about 0 mol %, about 5 mol %, about 10 mol %, or about 15 mol % to a high of about 20 mol %, about 25 mol %, or about 30 mol %, on a dry basis. For example, the syngas in line 101 can have a carbon dioxide concentration of about 0.1 mol % to about 30 mol %, about 0.5 mol % to about 20 mol %, about 1 mol % to about 15 mol %, or about 2 mol % to about 10 mol %, on a dry basis. The syngas in line 101 can have a methane concentration ranging from a low about 0 mol %, about 3 mol %, about 5 mol %, about 7 mol %, or about 9 mol % to a high of about 15 mol %, about 20 mol %, about 25 mol %, or about 30 mol %, on a dry basis. For example, the syngas in line 101 can have a methane concentration of about 2 mol % to about 19 mol %, about 4 mol % to about 17 mol %, about 6 mol % to about 15 mol %, or about 8 mol % to about 13 mol %, on a dry basis. The syngas in line 101 can have a nitrogen concentration of about 5 mol % or less, about 4 mol % or less, about 3 mol % or less, about 2 mol % or less, about 1 mol % or less, or about 0.5 mol % or less, on a dry basis. For example, the syngas in line 101 can have a nitrogen concentration of about 0.01 mol % to about 4.5 mol %, about 0.05 mol % to about 3.5 mol %, about 0.07 mol % to about 2.5 mol %, or about 0.1 mol % to about 1.5 mol %, on a dry basis. The syngas in line 101 can have an argon concentration of about 5 mol % or less, about 4 mol % or less, about 3 mol % or less, about 2 mol % or less, about 1 mol % or less, or about 0.5 mol % or less, on a dry basis. For example, the syngas in line 101 can have an argon concentration of about 0.01 mol % to about 3.5 mol %, about 0.02 mol % to about 2.5 mol %, or about 0.03 mol % to about 1.5 mol %, on a dry basis. The syngas in line 101 can have a water concentration of about 5 mol % or less, about 4 mol % or less, about 3 mol % or less, about 2 mol % or less, about 1 mol % or less, or about 0.5 mol % or less, on a wet basis. For example, the syngas in line 101 can have a water concentration of about 0.01 mol % to about 3.5 mol %, about 0.05 mol % to about 2.5 mol %, or about 0.1 mol % to about 1.5 mol %, on a wet basis.

A low inert concentration, e.g., the low concentration of nitrogen and argon, in the treated syngas in line 101 can increase the heating value of the SNG produced by the methanation system 100. A higher methane concentration in the syngas via line 101 can be beneficial for SNG production because the methane concentration of the syngas can provide a product value, e.g., a heating value, and/or can also reduce the product gas recycle requirements to quench heat of the reaction within the methanation system 100. The methane concentration can also reduce auxiliary power consumption, capital costs, and operating costs of the methanation system 100.

The syngas in line 101 can have a temperature ranging from a low of about 0° C., about 5° C., about 10° C. about 15° C., about 20° C., or about 25° C. to a high of about 40° C., about 50° C., about 70° C., about 90° C., or about 100° C. For example, the syngas in line 101 can have a temperature of about 12° C. to about 43° C., about 18° C. to about 37° C., or about 22° C. to about 33° C. The pressure of the syngas in line 101 can range from about 500 kilopascals ("kPa") to about 10,000 kPa. For example, the pressure of the syngas in line 101 can range from a low of about 700 kPa, about 1,000 kPa, about 1,700 kPa, or about 2,500 kPa to a high of about 3,500 kPa, about 4,500 kPa, about 6,500 kPa, or about 8,500 kPa. In another example, the pressure of the syngas in line 101 can range from about 2,600 kPa to about 3,000 kPa, about 2,650 kPa to about 2,900 kPa, or about 2,700 kPa to about 2,850 kPa.

The syngas via line 101 can be introduced to the guard bed 105 to produce a purified or sulfur-lean syngas via line 107. For example, the guard bed 105 can remove sulfur and sulfur containing compounds, e.g., hydrogen sulfide, from the syngas via line 101. The guard bed 105 can be, but is not limited to, a particulate bed, for example, a zinc oxide (ZnO) bed.

The purified syngas in line 107 can also include, but is not limited to, hydrogen, carbon monoxide, methane, carbon dioxide, nitrogen, argon, sulfur, sulfur containing compounds, or any combination thereof. The purified syngas in line 107 can have less than about 50 ppm, less than about 25 ppm, less than about 10 ppm, less than about 7 ppm, less than about 5 ppm, less than about 3 ppm, less than about 1 ppm, or less than, about 0.5 ppm of sulfur and/or sulfur containing compounds, and can otherwise have similar concentrations to the syngas in line 101.

The purified syngas in line 107 can be at a temperature ranging from a low of about 0° C., about 5° C., about 10° C., about 15° C., about 20"C, or about 25° C. to a high of about 40° C. about 50° C. about 70° C., about 90° C., or about 100° C. For example, the purified syngas line 107 can be at a temperature of about 12° C. to about 43° C. about 18° C. to about 37° C., or about 22° C. to about 33° C. The purified syngas in line 107 can be at a pressure ranging from about 500 kPa to about 10,000 kPa. For example, the pressure of the purified syngas in line 107 can range from a low of about 700 kPa, about 1,000 kPa, about 1,700 kPa, or about 2,500 kPa to a high of about 3,500 kPa, about 4,500 kPa, about 6,500 kPa, or about 8,500 kPa. In another example, the pressure of the purified syngas in line 107 can range from about 2,600 kPa to about 3,000 kPa, about 2,650 kPa to about 2,900 kPa, or about 2,700 kPa to about 2,850 kPa.

The purified syngas via line 107 can be heated in the first heat exchanger or preheater 110 to produce a first heated syngas via line 111. The first heated syngas via line 111 can be at a temperature ranging from a low of about 50° C., about 100° C., or about 150° C. to a high of about 200° C., about 250° C., or about 375° C. For example, the first heated syngas via line 111 can be at a temperature of about 75° C. to about 150° C., about 100° C. to about 200° C., about 125° C. to about 175° C., about 140° C. to about 240° C., or about 90° C. to about 150° C. The first heated syngas in line 111 can be at a pressure of about 500 kPa to about 10,000 kPa. For example, the first heated syngas in line 111 can be at a pressure ranging from a low of about 700 kPa, about 1,000 kPa, about 1,700 kPa, or about 2,500 kPa to a high of about 3,500 kPa, about 4,500 kPa, about 6,500 kPa, or about 8,500 kPa. In another example, the first heated syngas in line 111 can be at a pressure of about 2,600 kPa to about 3,000 kPa, about 2,650 kPa to about 2,900 kPa, or about 2,700 kPa to about 2,850 kPa.

The first heated syngas via line 111 can be introduced to and further heated within the second heat exchanger 115 to produce a second heated syngas via line 116. The second heated syngas via line 116 can be at a temperature ranging from a low of about 175° C., about 200° C., about 210° C. or about 220° C. to a high of about 240° C., about 250° C., about 275° C., or about 300° C. For example, the second heated syngas via line 116 can be at a temperature ranging from about 195° C. to about 265° C. about 205° C. to about 255° C., or about 215° C. to about 245° C. The second heated syngas in line 116 can be at a pressure ranging from about 500 kPa to about 10,000 kPa. For example, the pressure of the second heated syngas in line 116 can range from a low of about 700 kPa, about 1,000 kPa, about 1,700 kPa, or about 2,500 kPa to a high of about 3,500 kPa, about 4,500 kPa, about 6,500 kPa, or about 8,500 kPa. In another example, the pressure of the second heated syngas in line 116 can range from about 2,600 kPa to about 3,000 kPa, about 2,650 kPa to about 2,900 kPa, or about 2,700 kPa to about 2,850 kPa.

The second heated syngas in line 116 can be split, divided, or otherwise separated (e.g., via the one or more manifolds or splitters 198) into two or more portions. For example, as shown in FIG. 1, the second heated syngas introduced via line 116 to the splitter 198 can be split into a first syngas via line 117, a second syngas via line 118, and a third syngas via line 119. In another example, the second heated syngas introduced via line 116 to the splitter 198 can be split into two portions, three portions, four portions, five portions, six portions, seven portions, eight portions, nine portions, ten portions, or more. The second heated syngas introduced via line 116 to the splitter 198 can be split into equal portions, unequal portions, or, if split into three or more portions into a combination of equal and unequal portions. Any two or three of the first, second, and third syngas via lines 117, 118, 119, respectively, can be equally or unequally split with respect to one another. For example, the first syngas via line 117 can be about 10% to about 90% of the total amount of the second heated syngas in line 116. In another example, the second syngas in via line 118 can be about 10% to about 90% of the total amount of the second heated syngas in line 116. In another example, the third syngas via line 119 can be about 10% to about 90% of the total amount of the second heated syngas in line 116. In another example, the first syngas via line 117 can be about 30% to about 35% of the total amount of the second heated syngas in line 116, the second syngas via line 118 can be about 30% to about 35% of the total amount of the second heated syngas in line 116, and the third syngas via line 119 can be about 30% to about 35% of total amount of the second heated syngas in line 116. In yet another example, the first syngas via line 117 can be about 29% to about 31%, the second syngas via line 118 can be about 31% to about 34%, and the third syngas via line 119 can be about 34% to about 37% of the total amount of the second heated syngas in line 116.

The first syngas via line 117 can be introduced to the one or more first methanators 120 to produce a first effluent via line 121. The first effluent in line 121 can include, but is not limited to methane, water, hydrogen, carbon monoxide, carbon dioxide, nitrogen, argon, or any combination thereof. The first effluent in line 121 can have a methane concentration ranging from a low of about 30 mol %, about 40 mol %, or about 50 mol % to a high of about 60 mol %, about 70 mol %, or about 80 mol %, on a wet basis. For example, the first effluent in line 121 can have a methane concentration of about 35 mol % to about 75 mol %, about 45 mol % to about 65 mol %, or about 55 mol % to about 60 mol %, on a wet basis. The first effluent in line 121 can have a water concentration ranging from a low of about 10 mol %, about 20 mol %, or about 30 mol % to a high of about 40 mol %, about 50 mol %, or about 60 mol %, on a wet basis. For example, the first effluent in line 121 can have a water concentration of about 15 mol % to about 55 mol % or about 25 mol % to about 45 mol %, on a wet basis. The first effluent in line 121 can have a hydrogen concentration ranging from a low of about 0.1 mol %, about 0.5 mol %, about 1 mol %, or about 2 mol % to a high of about 4 mol %, about 6 mol %, about 8 mol %, or about 10 mol %, on a wet basis. For example, the first effluent in line 121 can have a hydrogen concentration of about 0.3 mol % to about 9 mol %, about 0.75 mol % to about 7 mol %, or about 1.5 mol % to about 5 mol %, on a wet basis. The first effluent in line 121 can have a carbon dioxide concentration of about 5 mol % or less, about 4 mol % or less, about 3 mol % or less, about 2 mol % or less, or about 1 mol % or less, on a wet basis. For example, the first effluent in line 121 can have a carbon dioxide concentration of about 0.1 mol % to about 4.5 mol %, about 0.2 mol % to about 3.5 mol %, about 0.3 mol % to about 2.5 mol %, or about 0.4 mol % to about 1.5 mol %, on a wet basis. The first effluent in line 121 can have a carbon monoxide concentration of about 5 mol % or less, about 3 mol % or less, about 2 mol % or less, about 1 mol % or less, about 0.5 mol % or less, about 0.1 mol % or less, about 0.05 mol % or less, or about 0.01 mol % or less, on a wet basis. For example, the first effluent in line 121 can have a carbon monoxide concentration of about 0.001 mol % to about 0.7 mol %, about 0.002 mol % to about 0.3 mol %, or about 0.003 mol % to about 0.2 mol %, on a wet basis. The first effluent in line 121 can have a nitrogen concentration of about 5 mol % or less, about 4 mol % or less, about 3 mol % or less, about 2 mol % or less, about 1 mol % or less, or about 0.5 mol % or less, on a wet basis. For example, the first effluent in line 121 can have a nitrogen concentration of about 0.01 mol % to about 3.5 mol %, about 0.05 mol % to about 2.5 mol %, about 0.07 mol % to about 1.5 mol %, or about 0.1 mol % to about 0.5 mol %, on a wet basis. The first effluent in line 121 can have an argon concentration of about 5 mol % or less, about 4 mol % or less, about 3 mol % or less, about 2 mol % or less, about 1 mol % or less, or about 0.5 mol % or less, on a wet basis. For example, the first effluent in line 121 can have an argon concentration of about 0.01 mol % to about 3.5 mol %, about 0.03 mol % to about 2.5 mol %, about 0.05 mol % to about 1.5 mol %, or about 0.07 mol % to about 0.3 mol %, on a wet basis.

The first effluent in line 121 can be at a temperature ranging from a low of about 300° C. about 350° C., about 375° C., or about 400° C. to a high of about 450° C., about 500° C. about 600° C. about 700° C., about 800° C. or about 850° C. For example, the first effluent in line 121 can be at a temperature ranging from about 375° C. to about 440° C. about 400° C. to about 600° C. about 4.50° C. to about 700° C., about 500° C. to about 800° C., or about 390° C. to about 430° C. The pressure of the first effluent in line 121 can range from about 500 kPa to about 10,000 kPa. For example, the pressure of the first effluent in line 121 can range from a low of about 700 kPa, about 1,000 kPa, about 1,700 kPa, or about 2,500 kPa to a high of about 3,500 kPa, about 4,500 kPa, about 6,500 kPa, or about 8,500 kPa. In another example, the first effluent in line 121 can range from about 2,600 kPa to about 3,000 kPa, about 2,650 kPa to about 2,900 kPa, or about 2,700 kPa to about 2,850 kPa.

The first effluent via line 121 can be introduced to the third heat exchanger or heat recovery unit 125 to produce a first cooled effluent via line 127. The first cooled effluent in line 127 can be at a temperature ranging from a low of about 190° C. about 200° C. about 210° C., or about 220° C. to a high of about 250° C., about 275° C., about 325° C., or about 375° C. For example, the first cooled effluent in line 127 can be at a temperature ranging from about 205° C. to about 265° C., about 220° C. to about 300° C., about 215° C. to about 245° C. about 260° C. to about 340° C., or about 275° C. to about 360° C. The first cooled effluent in line 127 can be at a pressure ranging from about 500 kPa to about 10,000 kPa. For example, the pressure of the first cooled effluent in line 127 can range from a to of about 700 kPa, about 1,000 kPa, about 1,700 kPa, or about 2,500 kPa to a high of about 3,500 kPa, about 4,500 kPa, about 6,500 kPa or about 8,500 kPa. In another example, the pressure of the first cooled effluent in line 127 can range from about 2,600 kPa to about 3,000 kPa, about 2,650 kPa to about 2,900 kPa, or about 2700 kPa to about 2,850 kPa.

The first cooled effluent via line 127 can be combined with the second syngas in line 118 to produce a first mixed effluent via line 128. The first mixed effluent in line 128 can include, but is not limited to, hydrogen, carbon monoxide, carbon dioxide, methane, nitrogen, argon, water, sulfur or sulfur containing compounds, or any combination thereof.

The first mixed effluent in line 128 can have a methane concentration ranging from a low of about 15 mol % about 25 mol %, about 35 mol %, or about 45 mol % to a high of about 55 mol %, about 60 mol %, about 65 mol %, or about 70 mol %, on a wet basis. For example, the first mixed effluent in line 128 can a have a methane concentration of about 10 mol % to about 67 mol %, about 20 mol % to about 63 mol %, or about 30 mol % to about 57 mol %, on a wet basis. The first mixed effluent in line 128 can have a water concentration ranging from a low of about 10 mol %, about 20 mol %, or about 30 mol % to a high of about 40 mol %, about 50 mol %, or about 60 mol %, on a wet basis. For example, the first mixed effluent in line 128 can have a water concentration of about 15 mol % to about 55 mol % or about 25 mol % to about 45 mol %, on a wet basis. The first mixed effluent in line 128 can have a hydrogen concentration ranging from a low of about 4 mol %, about 6 mol %, about 8 mol %, about 10 mol %, or about 12 mol % to a high of about 13 mol %, about 15 mol %, about 17 mol %, about 19 mol %, or about 21 mol %, on a wet basis. For example, the first mixed effluent in line 128 can have a hydrogen concentration of about 5 mol % to about 20 mol %, about 7 mol % to about 18 mol %, about 9 mol % to about 16 mol %, or about 11 mol % to about 14 mol %, on a wet basis. The first mixed effluent in line 128 can have a carbon monoxide concentration ranging from a low of about 0.5 mol %, about 1 mol %, about 2 mol %, or about 3 mol % to a high of about 4 mol %, about 6 mol %, about 8 mol %, or about 10 mol %, on a wet basis. For example, the first mixed effluent in line 128 can have a carbon monoxide concentration of about 0.75 mol % to about 9 mol %, about 1.5 mol % to about 7 mol %, or about 2.5 mol % to about 5 mol %, on a wet basis. The first mixed effluent in line 128 can have a carbon dioxide concentration of about 5 mol % or less, about 4 mol % or less, about 3 mol % or less, about 2 mol % or less, or about 1 mol % or less, on a wet basis. For example, the first mixed effluent in line 128 can have a carbon dioxide concentration of about 0.1 mol % to about 4.5 mol %. about 0.2 mol % to about 3.5 mol %, about 0.3 mol % to about 2.5 mol %, or about 0.4 mol % to about 1.5 mol %, on a wet basis. The first mixed effluent in line 128 can have a nitrogen concentration of about 5 mol % or less, about 4 mol % or less, about 3 mol % or less, about 2 mol % or less, about 1 mol % or less, or about 0.5 mol % or less, on a wet basis. For example, the first mixed effluent in line 128 can have a nitrogen concentration of about 0.01 mol % to about 3.5 mol %, about 0.05 mol % to about 2.5 mol %, about 0.07 mol % to about 1.5 mol %, or about 0.1 mol % to about 0.5 mol %, on a wet basis. The first mixed effluent via line 128 can have an argon concentration of about 5 mol % or less, about 4 mol % or less, about 3 mol % or less, about 2 mol % or less, about 1 mol % or less, or about 0.5 mol % or less, on a wet basis. For example, the first mixed effluent in line 128 can have an argon concentration of about 0.01 mol % to about 3.5 mol %, about 0.03 mol % to about 2.5 mol %, about 0.05 mol % to about 1.5 mol %, or about 0.07 mol % to about 0.3 mol %, on a wet basis.

The first mixed effluent in line 128 can be at a temperature ranging from a low of about 190° C., about 200° C., about 210° C. or about 220° C. to a high of about 250° C., about 275° C., about 325° C. or about 375° C. For example, the first mixed effluent in line 128 can be at a temperature ranging from about 205° C. to about 265° C., about 220° C., to about 300° C., about 215° C. about 245° C., about 260° C. to about 340° C., or about 275° C. to about 360° C. The first mixed effluent in line 128 can be at a pressure ranging from about 500 kPa to about 10,000 kPa. For example, the pressure of the first mixed effluent in line 128 can range from a low of about 700 kPa, about 1,000 kPa, about 1,700 kPa, or about 2,500 kPa to a high of about 3,500 kPa, about 4,500 kPa, about 6,500 kPa, or about 8.500 kPa. In another example, the pressure of the first mixed effluent in line 128 can range from about 2,600 kPa to about 3,000 kPa, about 2,650 kPa to about 2,900 kPa, or about 2,700 kPa to about 2,850 kPa.

The first mixed effluent via line 128 can be introduced to the one or more second methanators 130 to produce a second effluent via line 131. The second effluent in line 131 can include, but is not limited to, methane, water, hydrogen, carbon monoxide, carbon dioxide, nitrogen, argon, or any combination thereof.

The second effluent in line 131 can have a methane concentration ranging from a low of about 30 mol %, about 40 mol %, or about 50 mol % to a high of about 60 mol %, about 70 mol %, or about 80 mol %, on a wet basis. For example, the second effluent in line 131 can have a methane concentration of about 35 mol % to about 75 mol %, about 45 mol % to about 65 mol %, or about 55 mol % to about 60 mol %, on a wet basis. The second effluent in line 131 can have a water concentration ranging from a low of about 10 mol %, about 20 mol %, or about 30 mol % to a high of about 40 mol %, about 50 mol %, or about 60 mol %, on a wet basis. For example, the second effluent in line 131 can have a water concentration of about 15 mol % to about 55 mol % or about 23 mol % to about 45 mol %, on a wet basis. The second effluent in line 131 can have a hydrogen concentration ranging from a low of about 0.1 mol %, about 0.5 mol %, about 1 mol %, or about 2 mol % to a high of about 4 mol %, about 6 mol %, about 8 mol %, or about 10 mol %, on a wet basis. For example, the second effluent in line 131 can have a hydrogen concentration of about 0.3 mol % to about 9 mol %, about 0.75 mol % to about 7 mol %, or about 1.5 mol % to about 5 mol %, on a wet basis. The second effluent in line 131 can have a carbon dioxide concentration of about 5 mol % or less, about 4 mol % or less, about 3 mol % or less, about 2 mol % or less, or about 1 mol % or less, on a wet basis. For example, the second effluent in line 131 can have a carbon dioxide concentration of about 0.1 mol % to about 4.5 mol %, about 0.2 mol % to about 3.5 mol %, about 0.3 mol % to about 2.5 mol %, or about 0.4 mol % to about 1.5 mol %, on a wet basis. The second effluent in line 131 can have a carbon monoxide concentration of about 5 mol % or less, about 3 mol % or less, about 2 enol or less, about 1 mol % or less, about 0.5 mol % or less, about 0.1 mol % or less, about 0.05 mol % or less, or about 0.01 mol % or less, on a wet basis. For example, the second effluent in line 131 can have a carbon monoxide concentration of about 0.001 mol % to about 0.7 mol %, about 0.002 mol % to about, 0.3 mol %, or about 0.003 mol % to about 0.2 mol %, on a wet basis. The second effluent in line 131 can have a nitrogen concentration of about 5 mol % or less, about 4 mol % or less, about 3 mol % or less, about 2 mol % or less, about 1 mol % or less, or about 0.5 mol % or less, on a wet basis. For example, the second effluent in line 131 can have a nitrogen concentration of about 0.01 mol % to about 3.5 mol %, about 0.05 mol % to about 2.5 mol %, about 0.07 mol % to about 1.5 mol %, or about 0.1 mol % to about 0.5 mol %, on a wet basis. The second effluent in line 131 can have an argon concentration of about 5 mol % or less, about 4 mol % or less, about 3 mol % or less, about 2 mol % or less, about 1 mol % or less, or about 0.5 mol % or less, on a wet basis. For example, the second effluent in line 131 can have an argon concentration of about 0.01 mol % to about 3.5 mol %, about 0.03 mol % to about 2.5 mol %, about 0.05 mol % to about 1.5 mol %, or about 0.07 mol % to about 0.3 mol %, on a wet basis.

The second effluent in line 131 can be at a temperature ranging from a low of about 300° C., about 350° C., about 375° C., or about 400° C. to a high of about 450° C., about 500° C., about 600° C., about 700° C., about 800° C., or about 850° C. For example, the second effluent in line 131 can be at a temperature ranging from about 375° C. to about 440° C., about 400° C. to about 600° C., about 450° C. to about 700° C., about 500° C. to about 800° C., or about 390° C. to about 430° C. The pressure of the second effluent in line 131 can range from about 500 kPa to about 10,000 kPa. For example, the pressure of the second effluent in line 131 can range from a low of about 700 kPa, about 1,000 kPa, about 1,700 kPa, or about 2,500 kPa to a high of about 3,500 kPa, about 4,500 kPa, about 6,500 kPa, or about 8,500 kPa. In another example, the second effluent in line 131 can range from about 2,600 kPa to about 3,000 kPa, about 2,650 kPa to about 2,900 kPa, or about 2,700 kPa to about 2,850 kPa.

The second effluent via line 131 can be introduced to the fourth heat exchanger or heat recovery unit 135 to produce a second cooled effluent via line 137. The second cooled effluent in line 137 can be at a temperature ranging from a low of about 190° C., about 200° C., about 210° C., or about 220° C. to a high of about 250° C., about 275° C., about 325° C., or about 375° C. For example, the second cooled effluent in line 137 can be at a temperature ranging from about 205° C. to about 265° C., about 220° C. to about 300° C., about 215° C. to about 245° C., about 260° C. to about 340° C., or about 275° C. to about 360° C. The second cooled effluent in line 137 can be at a pressure ranging from about 500 kPa to about 10.000 kPa. For example, the pressure of second cooled effluent in line 137 can range from a low of about 700 kPa, about 1,000 kPa, about 1,700 kPa, or about 2,500 kPa to a high of about 3,500 kPa, about 4,500 kPa, about 6,500 kPa, or about 8,500 kPa. In another example, the pressure of the second cooled effluent in line 137 can range from about 2,600 kPa to about 3,000 kPa, about 2,650 kPa to about 2,900 kPa, or about 2,700 kPa to about 2,850 kPa.

The second cooled effluent in line 137 can be combined with the third syngas in line 119 to produce a second mixed effluent via line 138. The second mixed effluent in line 138 can include, but is not limited to, hydrogen, carbon monoxide, carbon dioxide, methane, nitrogen, argon, water, sulfur or sulfur containing compounds, or any combination thereof.

The second mixed effluent in line 138 can have a methane concentration ranging from a low of about 15 mol %, about 25 mol %, about 35 mol %, or about 45 mol % to a high of about 55 mol %, about 60 mol %, about 65 mol %, or about 70 mol %, on a wet basis. For example, the second mixed effluent in line 138 can a have a methane concentration of about 10 mol % to about 67 mol %, about 20 mol % to about 63 mol %, or about 30 mol % to about 57 mol %, on a wet basis. The second mixed effluent in line 138 can have a water concentration ranging from a low of about 10 mol %, about 20 mol %, or about 30 mol % to a high of about 40 mol %, about 50 mol %, or about 60 mol %, on a wet basis. For example, the second mixed effluent in line 138 can have a water concentration of about 15 mol % to about 55 mol % or about 25 mol % to about 45 mol %, on a wet basis. The second mixed effluent in line 138 can have a hydrogen concentration ranging from a low of about 4 mol %, about 6 mol %, about 8 mol %, about 10 mol %, or about 12 mol % to a high of about 13 mol %, about 15 mol %, about 17 mol %, about 19 mol %, or about 21 mol %, on a wet basis. For example, the second mixed effluent in line 138 can have a hydrogen concentration of about 5 mol % to about 20 mol %, about 7 mol % to about 18 mol %, about 9 mol % to about 16 mol %, or about 11 mol % to about 14 mol %, on a wet basis. The second mixed effluent in line 138 can have a carbon monoxide concentration ranging from a low of about 0.5 mol %, about 1 mol %, about 2 mol %, or about 3 mol % to a high of about 4 mol %, about 6 mol %, about 8 mol %, or about 10 mol %, on a wet basis. For example, the second mixed effluent in line 138 can have a carbon monoxide concentration of about 0.75 mol % to about 9 mol %, about 1.5 mol % to about 7 mol %, or about 2.5 mol % to about 5 mol %, on a wet basis. The second mixed effluent in line 138 can have a carbon dioxide concentration of about 5 mol % or less, about 4 mol % or less, about 3 mol % or less, about 2 mol % or less, or about 1 mol % or less, on a wet, basis. For example, the second mixed effluent in line 138 can have a carbon dioxide concentration of about 0.1 mol % to about 4.5 mol %, about 0.2 mol % to about 3.5 mol %, about 0.3 mol % to about 2.5 mol %, or about 0.4 mol % to about 1.5 mol %, on a net basis. The second mixed effluent in line 138 can have a nitrogen concentration of about 5 mol % or less, about 4 mol % or less, about 3 mol % or less, about 2 mol % or less, about 1 mol % or less, or about 0.5 mol % or less, on a wet basis. For example, second mixed effluent in line 138 can have a nitrogen concentration of about 0.01 mol % to about 3.5 mol %, about 0.05 mol % to about 2.5 mol %, about 0.07 mol % to about 1.5 mol %, or about 0.1 mol % to about 0.5 mol %, on a wet basis. The second mixed effluent in line 138 can have an argon concentration of about 5 mol % or less, about 4 mol % or less, about 3 mol % or less, about 2 mol % or less, about 1 mol % or less, or about 0.5 mol % or less, on a wet basis. For example, the second mixed effluent in line 138 can have an argon concentration of about 0.01 mol % to about 3.5 mol %, about 0.03 mol % to about 2.5 mol %, about 0.05 mol % to about 1.5 mol %, or about 0.07 mol % to about 0.3 mol %, on a wet basis.

The second mixed effluent in line 138 can be at a temperature ranging from a low of about 190° C., about 200° C., about 210° C., or about 220° C. to a high of about 250° C., about 275° C., about 325° C., or about 375° C. For example, the second mixed effluent in line 138 can be at a temperature ranging from about 205° C. to about 265° C., about 220° C. to about 300° C., about 215° C. to about 245° C., about 260° C. to about 340° C., or about 275° C. to about 360'C. The second mixed effluent in line 138 can be at a pressure ranging from about 500 kPa to about 10,000 kPa. For example, the pressure of the second mixed effluent in line 138 can range from a low of about 700 kPa, about 1,000 kPa, about 1,700 kPa, or about 2,500 kPa to a high of about 3,500 kPa, about 4,500 kPa, about 6,500 kPa, or about 8,500 kPa, in another example, the pressure of second mixed effluent in line 138 can range from about 2,600 kPa to about 3,000 kPa, about 2,650 kPa to about 2,900 kPa, or about 2,700 kPa to about 2,850 kPa.

The second mixed effluent via line 138 can be introduced to the one or more third methanators 140 to produce a third effluent via line 141. The third effluent in line 141 can include, but is not limited to, methane, water, hydrogen, carbon monoxide, carbon dioxide. nitrogen, argon, or an combination thereof.

The third effluent in line 141 can have a methane concentration ranging from it low of about 30 mol %, about 40 mol %, or about 50 mol % to a high of about 60 mol %, about 70 mol %, or about 80 mol %, on a wet basis. For example, the third effluent in line 141 can have a methane concentration of about 35 mol % to about 75 mol %, about 43 mol % to about 65 mol %, or about 55 mol % to about 60 mol %, on a wet basis. The third effluent in line 141 can have a water concentration ranging from a low of about 10 mol %, about 20 mol %, or about mol % to a high of about 40 mol %, about 50 mol %, or about 60 mol %, on a wet basis. For example, the third effluent in line 141 can have a water concentration of about 15 mol % to about 55 mol % or about 25 mol % to about 45 mol %, on a wet basis. The third effluent in line 141 can have a hydrogen concentration ranging from a low of about 0.1 mol %, about 0.5 mol %, about 1 mol %, or about 2 mol % to a high of about 4 mol %, about 6 mol %, about 8 mol %, or about 10 mol %, on a wet basis. For example, third effluent in line 141 can have a hydrogen concentration of about 0.3 mol % to about 9 mol %, about 0.75 mol % to about 7 mol %, or about 1.5 mol % to about 5 mol %, on a wet basis. The third effluent in line 141 can have a carbon dioxide concentration of about 5 mol % or less, about 4 mol % or less, about 3 mol % or less, about 2 mol % or less, or about 1 mol % or less, on a wet basis. For example, the third effluent in line 141 can have a carbon dioxide concentration of about 0.1 mol % to about 4.5 mol %, about 0.2 mol % to about 3.5 mol %, about 0.3 mol % to about 2.5 mol %, or about 0.4 mol % to about 1.5 mol %, on a wet basis. The third effluent in line 141 can have a carbon monoxide concentration of about 5 mol % or less, about 3 mol % or less, about 2 mol % or less, about 1 mol % or less, about 0.5 mol % or less, about 0.1 mol % or less, about 0.05 mol % or less, or about 0.01 mol % or less, on a wet basis. For example, the third effluent in line 141 can have a carbon monoxide concentration of about 0.001 mol % to about 0.7 mol %, about 0.002 mol % to about 0.3 mol %, or about 0.003 mol % to about 0.2 mol %, on a wet basis. The third effluent in line 141 can have a nitrogen concentration of about 5 mol % or less, about 4 mol % or less, about 3 mol % or less, about 2 mol % or less, about 1 mol % or less, or about 0.5 mol % or less, on a wet basis. For example, the third effluent in line 141 can have a nitrogen concentration of about 0.01 mol % to about 3.5 mol %, about 0.05 mol % to about 2.5 mol %, about 0.07 mol % to about 1.5 mol %, or about 0.1 mol % to about 0.5 mol %, on a wet basis. The third effluent in line 141 can have an argon concentration of about 5 mol % or less, about 4 or less, about 3 mol % or less, about 2 mol % or less, about 1 mol % or less, or about 0.5 mol % or less, on a wet basis. For example, the third effluent in line 141 can have an argon concentration of about 0.01 mol % to about 3.5 mol %, about 0.03 mol % to about 2.5 mol %, about 0.05 mol %, to about 1.5 mol %, or about 0.07 mol % to about 0.3 mol %, on a wet basis.

The third effluent in line 141 can be at a temperature ranging from a low of about 300° C., about 350° C., about 375° C., or about 400° C. to a high of about 450° C., about 500° C., about 600° C., about 700° C., about 800° C., or about 850° C. For example, the third effluent in line 141 can be at a temperature ranging from about 375° C. to about 440° C., about 400° C. to about 600° C., about 450° C. to about 700° C., about 500° C. to about 800° C., or about 390° C. to about 430° C. The pressure of the third effluent in line 141 can range from about 500 kPa to about 10,000 kPa. For example, the pressure of the third effluent in line 141 can range from a low of about 700 kPa, about 1,000 kPa, about 1,700 kPa, or about 2,500 kPa to a high of about 3,500 kPa, about 4,500 kPa, about 6,500 kPa, or about 8,500 kPa. In another example, the third effluent in line 141 can range from about 2,600 kPa to about 3,000 kPa, about 2,650 kPa to about 2,900 kPa, or about 2,700 kPa to about 2,850 kPa.

The third effluent via line 141 can be introduced to the fifth heat exchanger or heat recovery unit 145 to produce a third cooled effluent via line 147. The third cooled effluent in line 147 can be at a temperature ranging from a low of about 190° C., about 200° C., about 210° C., or about 220° C. to a high of about 250° C., about 275° C., about 325° C., or about 375° C. For example, the third cooled effluent in line 147 can be at a temperature ranging from about 205° C. to about 265° C., about 220° C. to about 300° C., about 215° C. to about 245° C., about 260° C. to about 340° C., or about 275° C. to about 360° C. The third cooled effluent in line 147 can be at a pressure ranging from about 500 kPa to about 10,000 kPa. For example, the pressure of third cooled effluent in line 147 can range from a low of about 700 kPa, about 1,000 kPa, about 1,700 kPa, or about 2,500 kPa to a high of about 3,500 kPa, about 4,500 kPa, about 6,500 kPa, or about 8,500 kPa. In another example, the pressure of the third cooled effluent in line 147 can range from about 2,600 kPa to about 3,000 kPa, about 2,650 kPa to about 2,900 kPa, or about 2,700 kPa to about 2,850 kPa.

At least a portion of the third cooled effluent via line 147 can be introduced to the second heat exchanger 115 to produce a fourth cooled effluent via line 122. The second heat exchanger 115 can transfer heat from the third cooled effluent in line 147 to the first heated syngas in line 111 to produce the second heated syngas via line 116.

The fourth cooled effluent in line 122 can be at as temperature ranging from a low of about 50° C., about 100° C., or about 150° C. to a high of about 300° C., about 400° C., or about 500° C. The fourth cooled effluent in line 122 can be at a pressure ranging from about 500 kPa to about 10,000 kPa. For example, the pressure of fourth cooled effluent in line 122 can range from a low of about 700 kPa, about 1,000 kPa, about 1,700 kPa, or about 2,500 kPa to a high of about 3,500 kPa, about 4,500 kPa, about 6,500 kPa, or about 8,500 kPa. In another example, the pressure of the fourth cooled effluent in line 122 can range from about 2,600 kPa to about 3,000 kPa, about 2,650 kPa to about 2,900 kPa, or about 2,700 kPa to about 2,850 kPa.

The fourth cooled effluent via line 122 can be introduced to the sixth heat exchanger 150 to produce a fifth cooled effluent via line 151. The sixth heat exchanger 150 can transfer heat from the fourth cooled effluent via line 122 to a heat transfer medium (not shown), e.g., boiler feed water.

The fifth cooled effluent in line 151 can be at a temperature ranging from a low of about 5° C. about 15° C., or about 25° C. to a high of about 50° C., about 75° C. or about 100° C. For example, the fifth cooled effluent in line 151 can be at a temperature of about 17° C. to about 53° C. about 23° C. to about 47° C., or about 27° C. to about 43° C. The fifth cooled effluent in line 151 can be at a pressure ranging from about 500 kPa to about 10,000 kPa. For example, the pressure of the filth cooled effluent in line 151 can range from a low of about 700 kPa, about 1,000 kPa, about 1,700 kPa, or about 2,500 kPa to a high of about 3,500 kPa, about 4,500 kPa, about 6,500 kPa, or about 8,500 kPa, in another example, the pressure of the fifth cooled effluent in line 151 can range from about 2,600 kPa to about 3,000 kPa, about 2,650 kPa to about 2,900 kPa, or about 2,700 kPa to about 2,850 kPa.

The fifth cooled effluent in line 151 can be introduced to the first vapor-liquid separators 155 to produce a first separated effluent via line 157 and a first condensate via line 156. The first separated effluent via line 157 can include, but is not limited to, methane, hydrogen, carbon dioxide, water, nitrogen, argon, carbon monoxide, or any combination thereof.

The first separated effluent via line 157 can have a methane concentration ranging from a low of about 90 mol %, about 92 mol %, or about 94 mol % to a high of about 95 mol %, about 97 mol %, or about 99 mol %, on a wet basis. For example, the first separated effluent via line 157 can have a methane concentration of about 91 mol % to about 98 mol %, about 93 mol % to about 96 mol %, or about 94.5 mol % to about 95 mol %, on a wet basis. The first separated effluent via line 157 can have a hydrogen concentration ranging from a low of about 0.001 mol %, about 1 mol %, about 2 mol %, or about 3 mol % to a high of about 4 mol %, about 5 mol %, about 5 mol %, or about 7 mol %, on a wet basis. For example, the first separated effluent via line 157 can have a hydrogen concentration of about 0.5 mol % to about 6.5 mol %, about 1.5 mol % to about 5.5 mol %, or about 2.5 mol % to about 4.5 mol %, on a wet basis. The first separated effluent via line 157 can have a carbon dioxide concentration ranging from a low of about 0.001 mol %, about 0.3 mol %, about 0.5 mol %, or about 0.7 mol % to a high of about 0.9 mol %, about 1.1 mol %, about 1.3 mol %, or about 1.5 mol %, on a wet basis. For example, the first separated effluent via line 157 can have a carbon dioxide concentration of about 0.2 mol % to about 1.4 mol %, about 0.4 mol % to about 1.2 mol %, or about 0.6 mol % to about 1 mol %, on a wet basis. The first separated effluent via line 157 can have a water concentration ranging from a low of about 0.001 mol %, about 0.2 mol %, about 0.4 mol %, or about 0.6 mol % to a high of about 0.7 mol %, about 0.9 mol %, about 1.1 mol %, or about 1.3 mol %, on a wet basis. For example, the first separated effluent via line 157 can have a water concentration of about 0.1 mol % to about 1.2 mol %, about 0.3 mol % to about 1 mol, or about 0.5 mol % to about 0.8 mol %, on a wet basis. The first separated effluent via line 157 can have a nitrogen concentration ranging from a low of about 0.5 mol % or less, about 0.4 mol % or less, or about 0.3 mol % or less, on a wet basis. For example, the first separated effluent via line 157 can have a nitrogen concentration of about 0.1 mol % to about 0.45 mol % or about 0.2 mol % to about 0.35 mol %, on a wet basis. The first separated effluent via line 157 can have an argon concentration ranging from a low of about 0.5 mol % or less, about 0.4 mol % or less, about 0.3 mol % or less, or about 0.2 mol % or less, on a wet basis. For example, the first separated effluent via line 157 can have an argon concentration of about 0.01 mol % to about 0.45 mol %, about 0.05 mol % to about 0.35 mol %, or about 0.1 mol % to about 0.025 mol %, on a we basis. The first, separated effluent via line 157 can have a carbon monoxide concentration ranging from a low of about 10 mol % or less, about 5 mol % or less, about 1 mol % or less, or about 0.1 mol % or less, on a wet basis. For example, the first separated effluent via line 157 can have a carbon monoxide concentration of about 0.004 mol % to about 0.1 mol %, or about 0.5 mol % to about 1.0 mol %, or about 2.0 mol % to about 3.0 mol %.

The first condensate in line 156 can include, but is not limited to, water. For example, the first condensate in line 156 can have a water concentration of about 95 mol % or more, about 98 mol % or more, 99 mol % or more, or 100 mol %.

The first separated effluent via line 157 can be introduced to the fourth heat exchanger 158 to produce a heated effluent via line 159. The fourth heat exchanger 158 can transfer heat from a heat transfer medium (not shown), e.g. boiler feed water, to the first separated effluent in line 157.

The heated effluent in line 159 can be at a temperature ranging from a low of about 100° C., about 150° C., about 200° C., or about 250° C. to a high of about 300° C., about 350° C. about 375° C., or about 400° C. For example, the heated effluent in line 159 can be at a temperature ranging from about 210° C. to about 310° C., about 240° C. to about 280° C., or about 250° C. to about 270° C. The heated effluent in line 159 can be at a pressure ranging from about 500 kPa to about 10,000 kPa. For example, the heated effluent in line 159 can be at a pressure ranging from a low of about 700 kPa, about 1,000 kPa, about 1,700 kPa, or about 2,500 kPa to a high of about 3,500 kPa, about 4.500 kPa, about 6,500 kPa, or about 8.500 kPa. In another example, the pressure of the heated effluent in line 159 can range from about 2,600 kPa to about 3,000 kPa, about 2.650 kPa to about 2,900 kPa, or about 2,700 kPa to about 2,850 kPa.

The heated effluent via line 159 can be introduced to the one or more fourth methanators 160 to produce a fourth effluent via line 161. The fourth effluent in line 161 can include, but is not limited to, methane, water, nitrogen, hydrogen, argon, carbon dioxide, carbon monoxide, or any combination thereof. The fourth effluent in line 161 can have to methane concentration ranging from a low of about 85 mol %, about 90 mol %, about 93 mol % to a high of about 97 mol %, about 98 mol %, about 99 mol %, or about 99.5 mol %, on a wet basis. For example, the fourth effluent in line 161 can have a methane concentration ranging from about 94.5 mol % to about 99.5 mol % or about 95.5 mol % to about 98.5 mol %, on a wet basis. The fourth effluent in line 161 can have a water concentration ranging from a low of about 0.001 mol %, about 1 mol %, about 1.5 mol %, or about 2 mol % to a high of about 2.5 mol %, about 3.5 mol %, about 4.5 mol %, or about 5.5 mol %, on a wet basis. For example, the fourth effluent in line 161 can have a water concentration ranging from about 0.5 mol %, to about 5 mol %, about 1.25 mol % to about 0.4 mol %, or about 1.8 mol % to about 3 mol %, on a wet basis. The fourth effluent in line 161 can have a nitrogen concentration of about 0.5 mol % or less, about 0.4 mol % or less, or about 0.3 mol % or less, on a wet basis. For example, the fourth effluent in line 161 can have a nitrogen concentration of about 0.1 mol % to about 0.45 mol % or about 0.2 mol % to about 0.35 mol %, on a wet basis. The fourth effluent in line 161 can have a hydrogen concentration of about 0.4 mol % or less, about 0.3 mol % or less, or about 0.2 mol % or less, on a wet basis. For example, the fourth effluent in line 161 can have a hydrogen concentration of about 0.01 mol % to about 0.35 mol %, about 0.05 mol % to about 0.25 mol %, or about 0.1 mol % to about 0.15 mol %, on a wet basis. The fourth effluent in line 161 can have an argon concentration of about 0.4 mol % or less, about 0.3 mol % or less, or about 0.2 mol % or less, on a wet basis. For example, the fourth effluent in line 161 can have an argon concentration of about 0.01 mol % to about 0.35 mol %, about 0.05 mol % to about 0.25 mol %, or about 0.1 mol % to about 0.15 mol %, on a wet basis. The fourth effluent in line 161 can have a carbon dioxide concentration of about 0.1 mol % or less, about 0.08 mol % or less, about 0.06 mol % or less, or about 0.05 mol % or less, on a wet basis. The fourth effluent in line 161 can have a carbon monoxide concentration of about 5 mol % or less, 1 mol % or less, 0.1 mol % or less, or about 0.005% or less, on a wet basis.

The fourth effluent in line 161 can be at a temperature ranging from a low of about 200° C., about 225° C., about 250° C. or about 275° C. to a high of about 300° C., about 350° C. about 400° C., about 450° C. or about 500° C. For example, the fourth effluent in line 161 can be at a temperature ranging from about 240° C. to about 340° C., about 260° C. to about 310° C., or about 275° C. to about 295° C. The fourth effluent in line 161 can be at a pressure ranging from about 500 kPa to about 10,000 kPa. For example, the fourth effluent in line 161 can be at a pressure ranging from a low of about 700 kPa, about 1,000 kPa, about 1,700 kPa, or about 2,500 kPa to a high of about 3,500 kPa, about 4,500 kPa, about 6,500 kPa, or about 8,500 kPa. In another example, the fourth effluent in line 161 can be at a pressure ranging from about 2,600 kPa to about 3,000 kPa, about 2,650 kPa to about 2,900 kPa, or about 2,700 kPa to about 2,850 kPa.

The fourth effluent via line 161 can be introduced to the eighth heat exchanger 185 to produce a sixth cooled effluent via line 189. The eighth heat exchanger 185 can be or include, but is not limited to, a u-tube exchanger, a shell-and-tube exchanger, a plate and frame exchanger, a spiral wound exchanges, a tin-fan exchanger, an evaporative cooler, or any combination thereof. As discussed in more detail below, the fourth effluent in line 161 can be cooled within the eighth heat exchanger 185 by transferring heat from a heat transfer medium introduced via line 103.

The sixth cooled effluent in line 189 can be at a temperature ranging from a low of about 100° C. about 150° C. about 175° C., or about 200° C. to a high of about 250° C., about 300° C. about 350° C. or about 400° C. The sixth cooled effluent in line 189 can be at a pressure ranging from about 500 kPa to about 10,000 kPa. For example, the sixth cooled effluent in line 189 can be at a pressure ranging from a low of about 700 kPa, about 1,000 kPa, about 1,700 kPa, or about 2,500 kPa to a high of about 3,500 kPa, about 4,500 kPa, about 6,500 kPa, or about 8,500 kPa. In another example, the sixth cooled effluent in line 189 can be at a pressure of about 2,600 kPa to about 3,000 kPa, about 2,650 kPa to about 2,900 kPa, or about 2,700 kPa to about 2,850 kPa.

The sixth cooled effluent via line 189 can be introduced to the first heat exchanger 110 to produce a seventh cooled effluent via line 113. The seventh cooled effluent in line 113 can be at a temperature ranging from a low of about 5° C., about 15° C., or about 25° C. to a high of about 50° C., about 75° C., or about 100° C. For example, the seventh cooled effluent in line 113 can be at a temperature of about 17° C. to about 53° C., about 23° C. to about 47° C., or about 27° C. to about 43° C. The seventh cooled effluent in line 113 can be at a pressure ranging from about 500 kPa to about 10,000 kPa. Fr example, the pressure of the seventh cooled effluent in line 113 can range from a low of about 700 kPa, about 1,000 kPa, about 1,700 kPa, or about 2,500 kPa to a high of about 3,500 kPa, about 4,500 kPa, about 6,500 kPa, or about 8,500 kPa. In another example, the pressure of the seventh cooled effluent in line 113 can range from about 2,600 kPa to about 3,000 kPa, about 2,650 kPa to about 2,900 kPa, or about 2,700 kPa to about 2.850 kPa.

The seventh cooled effluent via line 113 can be introduced to the second vapor-liquid separator 165 to produce a second separated effluent via line 167 and a second condensate via line 169. The second separated effluent via line 167 can include, but is not limited to, methane, hydrogen, carbon dioxide, water, nitrogen, argon, carbon monoxide, or any combination thereof. The second separated effluent via line 167 can have a methane concentration ranging from a low of about 85 mol %, about 90 mol %, about 93 mol % to a high of about 97 mol %, about 98 mol %, about 99 mol %, about 99.5 mol %, or about 99.9 mol %, on a wet basis. For example, the second separated effluent via line 167 can have a methane concentration ranging from about 94.5 mol % to about 99.5 mol % or about 95.5 mol % to about 98.5 mol %, on a wet basis. The second separated effluent via line 167 can have a water concentration ranging from a low of about 0.001 mol %, about 1 mol %, about 1.5 mol %, or about 2 mol % to a high of about 2.5 mol %, about 3.5 mol %, about 4.5 mol %, or about 5.5 mol %, on a wet basis. For example, the second separated effluent via line 167 can have a water concentration ranging from about 0.5 mol % to about 5 mol %, about 1.25 mol % to about 0.4 mol %, or about 1.8 mol % to about 3 mol %, on a wet basis. The second separated effluent via line 167 can have a nitrogen concentration of about 0.5 mol % or less, about 0.4 mol % or less, or about 0.3 mol % or less, on a wet basis. For example, the second separated effluent via line 167 can have a nitrogen concentration of about 0.1 mol % to about 0.45 mol % or about 0.2 mol % to about 0.35 mol %, on a wet basis. The second separated effluent via line 167 can have a hydrogen concentration of about 0.4 mol % or less, about 0.3 mol % or less, or about 0.2 mol % or less, on a wet basis. For example, the second separated effluent via line 167 can have a hydrogen concentration of about 0.01 mol % to about 0.35 mol %, about 0.05 mol % to about 0.25 mol %, or about 0.1 mol % to about 0.15 mol %, on a wet basis. The second separated effluent via line 167 can have an argon concentration of about 0.4 mol % or less, about 0.3 mol % or less, or about 0.2 mol % or less, on a wet basis. For example, the second separated effluent via line 167 can have an argon concentration of about 0.01 mol % to about 0.35 mol %, about 0.05 mol % to about 0.25 mol %, or about 0.1 mol % to about 0.15 mol %, on a wet basis. The second separated effluent via line 167 can have a carbon dioxide concentration of about 0.1 mol % or less, about 0.08 mol % or less, about 0.06 mol % or less, or about 0.05 mol % or less, on a wet basis.

The second separated effluent in line 167 can be at a temperature ranging from a low of about 5° C., about 15° C., or about 25° C. to a high of about 50° C., about 75° C., or about 100° C. For example, the second separated effluent in line 167 can be at a temperature of about 17° C. to about 53° C., about 23° C. to about 47° C., or about 27° C. to about 43° C. The second separated effluent in line 167 can be at a pressure ranging from about 500 kPa to about 10,000 kPa. For example, the pressure of the second separated effluent in line 167 can range from a low of about 700 kPa, about 1,000 kPa, about 1,700 kPa, or about 2,500 kPa to a high of about 3,500 kPa, about 4,500 kPa, about 6,500 kPa, or about 8,500 kPa. In another example, the pressure of the second separated effluent in line 167 can range from about 2,600 kPa to about 3,000 kPa, about 2,650 kPa to about 2,900 kPa, or about 2,700 kPa to about 2,850 kPa.

The first and second vapor-liquid separators 155, 165 can at least partially separate the gas phase from the liquid phase. The first and second vapor-liquid separators 155, 165 can include vertical vessels in which gravity can cause the liquid to settle to the bottom of the vessels, where it can be withdrawn, e.g., as the first and second condensate via lines 156, 169. Suitable vapor-liquid separators can include, but are not limited to, flash drums, knock-out drums, compressor suction drums, compressor inlet drums, demisters, combinations thereof, or the like. Vapor in the vessels can travel upward at a design velocity, which can minimize the entrainment of any liquid droplets in the vapor as it exits the top of the vessels.

The second separated effluent via line 167 can be introduced to the first compressor 170 to produce a compressed effluent via line 171. The compressor 170 can increase the pressure of the second separated effluent to meet pipeline or other requirements.

The compressed effluent via line 171 can be introduced to the drier 175 to produce a dried effluent via line 177 and a third condensate or water vapor via line 179. The drier 175 can include, but is not limited to one or more molecular sieves, absorbents, adsorbents, flash tank separators, incinerators, or any combination thereof. Suitable absorbents can include, but are not limited to, glycol, alkali-earth halide salts, derivatives thereof, or mixtures thereof. Suitable adsorbents can include but are not limited to, activated alumina, silica gel, molecular sieves, activated carbon, derivatives thereof, or mixtures thereof. For example, the drier 175 can use glycol dehydration for removal of water, e.g., the condensate via line 179, and/or to depress hydrate formation in the SNG. Glycols used in the drier 175 can include triethylene glycol ("TEG"), diethylene glycol ("DEG"), ethylene glycol ("MEG"), and tetraethylene glycol ("TREG"). For example, TEG can be heated to a high temperature and put through a condensing system, which removes the water as waste and reclaims the TEG for continuous reuse within the system.

The dried effluent via line 177 can be introduced to the seventh heat exchanger or cooler 180 to produce a product or SNG product via line 181. As shown, the seventh heat exchanger 180 can include one or more air coolers. It will be appreciated, however, that any one or more of a number of types of coolers can be implemented. For example, the seventh heat exchanger 180 can include, but is not limited to, one or more U-tube heat exchangers, one or more shell-and-tube heat exchangers, one or more plate and frame heat exchangers, one or more spiral wound heat exchangers, one or more fin-fan heat exchangers, one or more evaporative coolers, or any combination thereof.

The SNG product in line 181 can include methane, water, nitrogen, hydrogen, argon, carbon dioxide, carbon monoxide, or any combination thereof. The SNG product in line 181 can have a methane concentration ranging from a low of about 75 mol %, about 80 mol %, about 85 mol %, or about 90 mol %, to a high of about 95 mol %, about 97 mol %, about 98 mol %, about 99 mol %, or about 100 mol %, on a wet basis. The methanation system 100 can convert from about 80% to about 100% of the carbon monoxide and carbon dioxide in the syngas introduced via line 101 to methane. For example, the amount of the carbon monoxide and carbon dioxide contained in the syngas in line 101 that can be converted to SNG can be about 90% or more, about 93% or more, about 95% or more, about 97% or more, 98% or more, or 99% or more.

Referring back to the third cooled effluent via line 147, a portion can be recycled to the first syngas in line 117 and/or fed directly to the first methanator 120. For example, a portion of the third cooled effluent in line 147 or "recycle effluent" can be introduced via line 148 to the ninth heat exchanger 190 to produce an eighth cooled effluent or a cooled recycle effluent via line 193. The amount of the third cooled effluent in line 147 that can be recycled to the syngas in line 117 and/or directly to the first methanator 120 can range from a low of about 10%, about 20%, about 30%, about 40%, about 50%, about 60%, or about 70% to a high of about 80%, about 90%, or about 95%. For example, about 50% to about 90%, about 55% to about 85%, about 70% to about 80%, or about 72% to about 78% of the third cooled effluent in line 147 can be recycled and/or introduced via line 148 to the ninth heat exchanger 190.

The cooled recycle effluent in line 193 can be at a temperature ranging from a low of about 50° C., about 100° C., or about 150° C. to a high of about 200° C., about 250° C., or about 300° C. The cooled recycle effluent in line 193 can be at a pressure ranging from about 500 kPa to about 10,000 kPa. For example, the pressure of the cooled recycle effluent in line 193 can range from a low of about 700 kPa, about 1,000 kPa, about 1,700 kPa, or about 2,500 kPa to a high of about 3,500 kPa, about 4,500 kPa, about 6,500 kPa, or about 8,500 kPa. In another example, the pressure of the cooled recycle effluent in line 193 can range from about 2,600 kPa to about 3,000 kPa, about 2,650 kPa to about 2,900 kPa, or about 2,700 kPa to about 2,850 kPa.

The cooled recycle effluent via line 193 can be introduced to the second compressor 197 to produce a compressed recycle effluent via line 199. The compressed recycle effluent in line 199 can be at a pressure of about 500 kPa to about 14,000 kPa. For example, the compressed recycle effluent in line 193 can be at a pressure ranging from a low of about 700 kPa, about 1,000 kPa, about 2,000 kPa, or about 3,500 kPa to a high of about 4,500 kPa, about 5,500 kPa, about 7,500 kPa, or about 9,500 kPa. The compressed recycle effluent in line 199 can be at a temperature ranging from a low of about 175° C., about 200° C., about 210° C., or about 220° C. to a high of about 240° C., about 250° C., about 275° C., or about 300° C. For example, the compressed recycle effluent in line 199 can be at a temperature ranging, from about 195° C. to about 265° C., about 205° C. to about 255° C., or about 215° C. to about 245° C. The compressed recycle effluent via line 199 can be mixed or combined with the first syngas in line 117 to produce a mixture or third effluent and first syngas mixture and/or introduced directly to the first methanator 120.

The heat transfer medium via line 103 can be introduced to the eighth heat exchanger 185 to produce a first heated heat transfer medium via line 187. For example, the eighth heat exchanger 185 can transfer heat from the fourth effluent via line 161 to the heat transfer medium via line 103 to produce the first heated heat transfer medium via line 187.

The first heated heat transfer medium via line 187 can be introduced to the ninth heat exchanger 190 to provide a second heated heat transfer medium via line 191. For example, the ninth heat exchanger 190 can transfer heat from the recycle effluent in line 148 to the first heated heat transfer medium in line 187 to produce the second heated heat transfer medium via line 191. In another example, the ninth heat exchanger 190 can transfer heat to the recycle effluent in line 148 from the first heated heat transfer medium in line 187.

The heat transfer medium in line 103, the first heated heat transfer medium via line 187, and the second heated heat transfer medium via line 191 can be at a pressure ranging from a low of about 500 kPa, about 1,000 kPa, about 2,500 kPa, about 4,000 kPa, or about 6,000 kPa to a high of about 10,000 kPa, about 12,000 kPa, about 14,000 kPa, about 16,000 kPa, or about 18,000 kPa. The heat transfer medium in line 103, the first heated heat transfer medium via line 187, and the second heated heat transfer medium via line 191 can be at a temperature ranging from a low of about 90°, about 125° C., or about 150° C. to a high of about 250° C., about 275° C., about 200° C., or about 325° C. The heat transfer mediums in lines 103, 187, and 191 can be or include liquid phase heat transfer mediums. For example, if the heat transfer medium in line 103 is or includes boiler feed water, the boiler feed water in lines 103, 187, and 191 can be 90% liquid, 95% liquid, 97% liquid, 98% liquid, 99% liquid, or 100% liquid phase.

The second heated heat transfer medium via line 191 can be introduced to the one or more heat transfer medium collector/separators 195 to produce a heat recovery medium via lines 124, 134, and 144 for the heat exchangers 125, 135, 145. A heated heat transfer medium via line 196 can be recovered from the heat transfer medium collector/separator 195. Although not shown, the heat transfer medium collector/separator 195 can include a plurality of discrete or separate vessels or other apparatus. For example, the heat transfer medium collector/separator 195 can include two, three, four, five, six, seven, eight, nine, ten, or more vessels or other apparatus. The heat transfer medium collector/separator 195 can separate a gaseous phase heat transfer medium from liquid phase heat transfer medium. For example, when the heat transfer medium in line 191 is water and/or a water/steam, mixture, the steam within the heat transfer medium collector/separator 195 can be recovered as the heated heat transfer medium via line 196. When the heat transfer medium is water, the heat transfer medium collector/separator 195 can also be referred to as a "steam drum" or "steam collector/separator."

A first heat recovery medium via line 124 can be introduced from the heat transfer medium collector/separator 195 to the third heat exchanger 125 to produce a first heated heat recovery medium stream via line 129. The third heat exchanger 125 can transfer heat from the first effluent in line 121 to the heat recovery medium to produce the first cooled effluent via line 127 and the first heated heat transfer recovery via line 129.

A second heat recovery medium via line 134 can be introduced from the heat transfer medium collector/separator 195 to the fourth heat exchanger 135 to produce a second heated heat recovery medium via line 139. The fourth beat exchanger 135 can transfer heat from the second effluent in line 131 to the second heat recovery medium to produce the second cooled effluent via line 137 and the second heated heat recovery medium via line 139.

A third heat recovery medium via line 144 can be introduced from the heat transfer medium collector/separator 195 to the fifth heat exchanger 145 to produce a third heated heat recovery medium via line 149. The fifth heat exchanger 145 can transfer heat from the third effluent in line 141 to the third heat recovery medium in line 144 to produce the third cooled effluent via line 147 and the third heated heat recovery medium via line 149.

The first, second, and third heated heat recovery mediums via lines 129, 139, and/or 149 can be or include saturated steam. For example, the first, second, and third heated heat recovery mediums in lines 129, 139, and/or 149 can be or include saturated steam in an amount ranging from a low of about 5 wt %, about 15 wt %, about 25 wt %, or about 35 wt % to a high of about 60 wt %, about 70 wt %, about 80 wt %, about 90 wt %, or about 95 wt %. The first, second, and third heated heat recovery mediums in lines 129, 139, and/or 149 can be at a temperature ranging from a low of about 172° C., about 220° C., or about 260° C. to a high of about 275° C., about 310° C., or about 343° C. The first, second, and third heated heat recovery mediums via lines 129, 139, and 149 can be introduced to the heat transfer medium collector/separator 195.

The heat exchangers 125, 135, 445 can be, but are not limited to, u-tube exchangers, shell-and-tube exchangers, plate and frame exchangers, spiral wound exchangers, fin-fan exchangers, evaporative coolers, or any combination thereof.

The heated heat transfer medium via line 196, e.g., saturated steam or superheated steam, can be used to power one or more steam turbines (not shown) that can drive a directly coupled electric generator (not shown), far example. The heated heat transfer medium via line 196 from the heat transfer medium collector/separator 195 can be saturated steam at a pressure ranging from a low of about 3,450 kPa, about 4,000 kPa, or about 5,000 kPa to a high of about 10,000 kPa, about 12,000 kPa, or about 14,000 kPa. For example, the heated heat transfer medium via line 196 can be saturated steam at a pressure of about 4,100 kPa to about 5,860 kPa, about 8,610 kPa to about 10,000 kPa, or about 12,000 kPa to about 13,800 kPa.

The methanators 120, 130, 140, 160 can include one or more of physical, mechanics electrical, and/or chemical systems to convert carbon monoxide and carbon dioxide to methane. The methanators 120, 130, 140, 160 can each include one or more reactors. For example, the methanators 120, 130, 140, 160 can include two or more reactors operating in series or in parallel.

The methanators 120, 130, 140, 160 can be or include one or more reactors operating at conditions sufficient to convert or react at least a portion of an carbon monoxide and/or carbon dioxide to methane and water. The methanators 120, 130, 140, 160 can include one or more reactors arranged in series or parallel operating at conditions sufficient for the conversion of carbon monoxide and carbon dioxide to methane. For example, at least one of the methanators 120, 130, 140, 160 can include two catalytic reactors operating in parallel, in another example, at least one of the methanators 120, 130, 140, 160 can include a single reactor. In one or more embodiments, the first methanator 120, the second methanator 130, and the third methanator 140 can each include two reactors operated in parallel and the fourth methanator 160 can include a single reactor.

The first methanator 120 can include a first catalyst, the second methanator 130 can include a second catalyst, the third methanator 140 can include a third catalyst, and the fourth methanator 160 can include a fourth catalyst. The first, second, and third catalysts can each be different than the fourth catalyst. The first, second, and third catalyst can be the same type of catalyst. Two or more of the first, second, and third catalysts can be different types of catalysts with respect to one another. In at least one example, the first syngas in line 117, the first mixture in line 128, and the second mixture in line 138 can be methanated in the presence of the first catalyst, the second catalyst, and the third catalyst, respectively, and the heated effluent in line 159 can be methanated in the presence of the fourth catalyst, where the first, second, and third catalysts are different from the fourth catalyst.

Suitable catalysts can include, but are not limited to, nickel, a rare earth promoted nickel, derivatives thereof, or combinations thereof. Other suitable catalysts can include, but are not limited to, cobalt, iron, ruthenium, "noble" Group VIII metals, molybdenum, tungsten, derivatives thereof, or combinations thereof. For example, the first, second, and third catalysts in the first, second, and third methanators 120, 130, and 140 can each be Nickel oxide and the fourth catalyst in the fourth methanator 140 can be Ruthenium.

The catalyst can vary in size and shape, as desired. For example, the catalyst can be shaped as rings, toroids, cylinders, rods, pellets, ellipsoids, spheres, tri-lobes, cubes, pyramids, cones, stars, daisies, combinations thereof, or the like. The catalyst may or may not be grooved and/or notched. In another example, the catalyst used can be, but is not limited to, 6×6×2 mm ring shaped and/or 6-3 mm spherical shaped structures. In one or more embodiments, the 6×6×2 mm ring shaped catalyst structure can be used in the first methanator 120, the second methanator 130, and the third methanator 140 and the 6-3 mm spherical shaped structure can be used in the fourth methanator 160.

Figure 2:
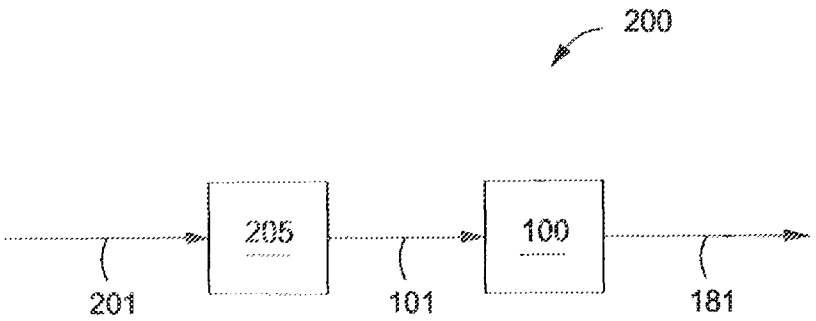
FIG. 2 depicts a schematic of an illustrative synthetic natural gas production system, according to one or more embodiments described.

FIG. 2 depicts a schematic of an illustrative system 200 for producing synthetic natural gas 181, according to one or more embodiments. The system 200 can include one or more gasification systems 205 and one or more methanation systems 100. The methanation system 100 can be as discussed and described above with reference to FIG. 1. A feedstock via line 201 can be introduced to the gasification system 205 to produce the syngas via line 101. The syngas via line 101 can be introduced to the methanation system 100 to produce the SNG is line 181 as discussed and described above with reference to FIG. 1.

The term "feedstock," as used herein, refers to one or more carbon containing materials, whether solid, gas, liquid, or any combination thereof. The feedstock in line 201 can include, but is not limited to, biomass (i.e., plant and/or animal matter or plant and/or animal derived matter), coal (i.e., high-sodium and low-sodium lignite, lignite, subbituminous, and/or anthracite), oil shale, coke, tar, asphaltenes, low ash or no ash polymers, hydrocarbon-based polymeric materials, biomass derived material, by-product derived from manufacturing operations, or any combination thereof. The hydrocarbon-based polymeric materials can include, but are not limited to, thermoplastics, elastomers, rubbers, including polypropylenes, polyethylenes, polystyrenes, including other polyolefins, homo polymers, copolymers, block copolymers, PET (polyethylene terephthalate), poly blends, poly-hydrocarbons containing oxygen, heavy hydrocarbon sludge and bottoms products from petroleum refineries and petrochemical plants such as hydrocarbon waxes, blends thereof, derivatives thereof, or any combination thereof.

The feedstock in line 201 can include a mixture or combination of two or more low ash or no ash polymers, biomass derived materials, or byproducts derived from manufacturing operations. For example, the feedstock in line 201 can include one or more carbonaceous materials combined with one or more discarded consumer products, such as carpet and/or plastic automotive parts/components, e.g., bumpers or dashboards. As necessary, such discarded consumer products can be reduced in size, for example ground up, prior to or during processing through the gasification system 205. The feedstock in line 201 can also include one or more recycled plastics such as polypropylene, polyethylene, polystyrene, derivatives thereof, blends thereof, or any combination thereof. Accordingly, the gasification system 205 can be useful for accommodating mandates for proper disposal of previously manufactured materials.

The gasification system 205 can be or include one or more circulating solids or transport gasifiers, one or more fixed bed gasifiers, one or more fluidized bed gasifiers, one or more entrained flow gasifiers, or any combination thereof. For example, circulating solids gasifiers can operate by introducing one or more oxidants to a feed stream, e.g., the feedstock via line 201, and/or to one or more mixing zones (not shown) to produce a gas mixture. In another example, the oxidant can be added directly to the gasifier. The type and amount of oxidant introduced to circulating solids gasifiers can influence the composition and physical properties of the syngas via line 101 and hence, the downstream products made therefrom. The one or more oxidants can be introduced into the one or more mixing zones to produce a gas mixture, and, for example, can be introduced at a rate suitable to control the temperature of the mixing zone. The gas mixture can move upward through the mixing zone into a riser (not shown) where residence time can allow char gasification, methane/steam reforming, tar cracking, and/or water-gas shift reactions to occur. The temperature in the mixing zone can start at from about 500° C. to about 650° C. and increase to about 900° C., for example if a coke breeze or an equivalent is fed therein. In one example, the riser can operate at a higher temperature than the mixing zone. The gas mixture can exit the riser and enter one or more disengagers or cyclones (not shown) where large particulates can be separated from the gas and recycled back to the mixing zone.

The residence time within circulating solids gasifiers can be from about 2 seconds or more to about 10 seconds or more, where the temperature can be sufficient for water-gas shift reactions to reach equilibrium (i.e., temperatures ranging from a low of about 250° C. to a high of about 1,200° C.). The operating temperature of circulating solids gasifiers can be controlled, at least in part, by the recirculation rate and residence time of the solids within the riser, by reducing the temperature of the ash prior to recycle to the mixing zone, by the addition of steam to the mixing zone, and/or by the addition of oxidant to the mixing zone. Recirculated solids can serve to rapidly heat the incoming feedstock via line 201, which can minimize tar formation. The mixing zone can be operated at a pressure of about 100 kPa to about 4,500 kPa to increase thermal output per unit reactor cross-sectional area and enhance energy output in any subsequent power cycle.

Since the outlet temperature of a circulating solids gasifier can be proportionately less than comparable gasifiers (e.g., slag type), the amount of thermal heat versus chemical heat in the syngas can be comparably less in the circulating solids gasifier. Because of the reduced operating temperature within the gasifier (i.e., less than 1,600° C.), less energy can be consumed to control and optimize the $H_2$:CO ratio, thus the production of hydrogen can be increased without a commensurate increase in steam demand within the gasifier. Suitable circulating solids gasifiers can be as discussed and described in U.S. Pat. No. 7,722,690 and U.S. Patent Application Nos. 2008/0155899, 2009/0151250, and 2009/0188165, which are each incorporated by reference herein in their entirety to the extent consistent with the present disclosure.

In another example, fixed bed or moving bed gasifiers can operate by introducing the feedstock 201 into an upper or top part of a reactor (not shown). Oxygen and/or steam can be introduced to fixed bed gasifiers at a lower or bottom part of the reactor. The feed can move down through the reactor by gravity and can be gasified. Ash remaining from the gasification can drop out of the bottom part of the reactor. Fixed bed gasifiers can be operated at relatively low outlet temperature (425° C. to 700° C.) and can require a lesser amount of oxygen compared to fluidized bed gasifiers and entrained flow gasifiers, but can have a high demand for steam and produce significant amounts of tar. Fixed bed gasifiers can have a limited ability to handle fines and can have special requirements for handling caking coal. The product syngas from fixed bed gasifiers can contain unconverted methane and/or by-product tars and oils. Suitable fixed bed gasifiers can be as discussed and described in U.S. Pat. Nos. 4,290,780; 4,417,528; and 5,069,685 and U.S. Patent Application Publication No. 2008/0086945, which are each incorporated by reference herein in their entirety to the extent consistent with the present disclosure.

In yet another example, fluidized bed gasifiers can operate by mixing solid particles from the feedstock 201 with older, partially gasified and/or fully gasified particles in a reactor (not shown). The solid particles can be fluidized with a gas and then the gas and remaining solid particles can be separated. Gas in the reactor can include oxygen, steam, recycled syngas, or a combination thereof. The flow of the gas into the reactor can be sufficient to float the solid particles without entraining them out of the reactor. Fluidized bed gasifiers can operate at moderate outlet temperatures and the temperature can be uniform throughout the bed. For example, fluidized bed gasifiers can operate at a temperature ranging from a low of about 700° C., about 750° C., about 800° C., or about 850° C. to a high of about 1.000° C., about 1,050° C., about 1,100° C., or about 1,150° C. Fluidized bed gasifier can require a greater amount of oxygen than comparable fixed bed gasifiers but less than comparable entrained flow gasifiers. Likewise, fluidized bed gasifier can require less steam than comparable fixed bed gasifiers but more than comparable entrained flow gasifiers. The syngas from fluidized bed gasifiers can be of higher purity than the syngas from comparable entrained flow gasifiers and the carbon conversion can be lower than comparable entrained flow gasifiers. Purity can be measured by the amount of $H_2O$+CO in the syngas. For example, the purity of the syngas in a fluidized bed gasifier can range from 25% to 90% $H_2$+CO. The carbon conversion in a fluidized bed gasifier can range, for example, from a low of about 92%, about 93%, or about 94% to a high of about 97%, about 98%, or about 99%. Suitable fluidized bed gasifiers can be as discussed and described in U.S. Pat. Nos. 4,696,678; 6,972,114; 7,503,945; and 7,947,095, which are each incorporated by reference herein in their entirety to the extent consistent with the present disclosure.

Prophetic Example

Embodiments of the present invention can be further described with the following prophetic example. The following simulation uses a methanation system similar to the methanation system 100 discussed and described above. The simulation, however, uses only one heat exchanger prior to splitting the effluent between the first three methanators 120, 130, 140 and uses only one heat exchanger after recycling the cooled effluent from the fifth heat exchanger 145 and before vapor-liquid separation via the vapor-liquid separator 155. The simulation also does not include further processing cooling, separation, compression, and drying, of the effluent from the fourth methanator 160.

In this simulated example, a total of four methanation reactors are used, e.g., methanators 120, 130, 140, 160. The first three methanators operate with a recycle stream exiting the third methanator hack to the first methanator to dilute the incoming carbon monoxide concentration. A fresh feed stream from an upstream gasification and purification system is split into three portions with each portion introduced directly into the inlet of the first three methanators. A SNG—1000 catalyst in a 6×6×2 mm ring shape is used because of high moisture content in these first three methanation stages, since it is more tolerant to high moisture conditions and high temperatures. The fourth methanator, e.g., methanator 160, treats the portion of the flow exiting the third methanator that was not recycled back to the front end for dilution. This results in about 25% of a wet gas volume exiting the third methanator. Cooling and water separation steps are inserted into the process before the fourth methanator, and a feed or effluent to the final methanator is reheated to 260° C. (500° F.). For the dryer methanation process in the fourth methanator uses a Meth-134 catalyst in a 6-3 mm spherical shape.

Table 1 summarizes the simulated methanator configuration and design.

TABLE 1

| | 1st Reactor | 2nd Reactor | 3rd Reactor | 4th Reactor |
|---|---|---|---|---|
| No. of Reactors | 2 | 2 | 2 | 1 |
| Type Operation | Parallel | Parallel | Parallel | N.A. |
| Cat. Vol/Rx., CM | 50 | 50 | 50 | 23 |

TABLE 1-continued

| | 1st Reactor | 2nd Reactor | 3rd Reactor | 4th Reactor |
|---|---|---|---|---|
| Total Cat. Vol., CM | 100 | 100 | 100 | 23 |
| Catalyst Type | SNG 1000 | SNG 1000 | SNG 1000 | Meth-134 |
| Catalyst Size, mm | 6 × 6 × 2 ring | 6 × 6 × 2 ring | 6 × 6 × 2 ring | 6-3 sphere |
| Total W.G. Flow, kgmole/hr | 41,267.07 | 45,453.5 | 49,889.6 | 7255.46 |
| W.G. Flow/Rx, kgmole/hr | 20,633.54 | 22,726.75 | 24,944.8 | 7255.46 |
| Inlet Temp., ° C. | 230 | 230 | 230 | 260.0 |
| Outlet Temp., ° C. | 408 | 403 | 398 | 289 |
| Inlet Press., kPa | 2782 | 2753.5 | 2718.5 | 2437.3 |
| Δ Press., kPa | 25.6 | 30.9 | 36.7 | 26.7 |
| Rx GHSV, $hr^{-1}$ (wet) | 8,931 | 9,851 | 10,827 | 7,030 |
| S/G @ Inlet | 0.5007 | 0.5036 | 0.5096 | 0.0066 |
| S/G @ Outlet | 0.6594 | 0.6611 | 0.6626 | 0.0229 |

Tables 2-4 summarize the simulated results for the example. The stream numbers correspond to the line numbers depicted in FIG. 1.

TABLE 2

| | Stream No. | | | | | | | |
|---|---|---|---|---|---|---|---|---|
| | 101 | 116 | 119 | 118 | 117 | 121 | 127 | 128 |
| Temp. (° C.) | 27 | 230 | 230 | 230 | 230 | 408 | 230 | 229 |
| Press. (kPa) | 2,787 | 2,783 | 2,783 | 2,783 | 2,783 | 2,757 | 2,753 | 2,753 |
| Total (kmol/h) | 21,438 | 21,438 | 6,717 | 7,146 | 7,575 | 38,336 | 38,336 | 45,482 |
| Mol %: | | | | | | | | |
| $CH_4$ | 10.04 | 10.04 | 10.04 | 10.04 | 10.04 | 57.32 | 57.32 | 49.90 |
| $CO_2$ | 0.5 | 0.5 | 0.5 | 0.5 | 0.5 | 0.54 | 0.54 | 0.53 |
| CO | 21.83 | 21.83 | 21.83 | 21.83 | 21.83 | 0.003 | 0.003 | 3.43 |
| $H_2$ | 67.49 | 67.49 | 67.49 | 67.49 | 67.49 | 2.15 | 2.15 | 12.42 |
| $H_2O$ | 0 | 0 | 0 | 0 | 0 | 39.74 | 39.74 | 33.49 |
| $N_2$ | 0.09 | 0.09 | 0.09 | 0.09 | 0.09 | 0.16 | 0.16 | 0.15 |
| Ar | 0.05 | 0.05 | 0.05 | 0.05 | 0.05 | 0.09 | 0.09 | 0.08 |

TABLE 3

| | Stream No. | | | | | | | |
|---|---|---|---|---|---|---|---|---|
| | 131 | 137 | 138 | 141 | 147 | 148 | 193 | 199 |
| Temp. (° C.) | 402 | 230 | 229 | 397 | 275 | 275 | 225 | 230 |
| Press. (kPa) | 2,722 | 2,719 | 2,719 | 2,682 | 2,678 | 2,678 | 2,674 | 2,783 |
| Total (kmol/h) | 42,314 | 42,314 | 49,889 | 46,532 | 46,532 | 34,549 | 34,549 | 34,549 |
| Mol %: | | | | | | | | |
| $CH_4$ | 57.37 | 57.37 | 50.19 | 57.41 | 57.41 | 57.41 | 57.41 | 57.41 |
| $CO_2$ | 0.51 | 0.51 | 0.51 | 0.49 | 0.49 | 0.49 | 0.49 | 0.49 |
| CO | 0.003 | 0.003 | 3.32 | 0.002 | 0.002 | 0.002 | 0.002 | 0.002 |
| $H_2$ | 2.06 | 2.06 | 11.99 | 1.99 | 1.99 | 1.99 | 1.99 | 1.99 |
| $H_2O$ | 39.8 | 39.8 | 33.76 | 39.85 | 39.85 | 39.85 | 39.85 | 39.85 |
| $N_2$ | 0.16 | 0.16 | 0.15 | 0.16 | 0.16 | 0.16 | 0.16 | 0.16 |
| Ar | 0.09 | 0.09 | 0.08 | 0.09 | 0.09 | 0.09 | 0.09 | 0.09 |

TABLE 4

| | Stream No. | | | | |
|---|---|---|---|---|---|
| | 151 | 156 | 157 | 159 | 161 |
| Temp. (° C.) | 35 | 35 | 35 | 260 | 288 |
| Press. (kPa) | 2,674 | 2,441 | 2,441 | 2,437 | 2,410 |
| Total (kmol/h) | 11,983 | 4,728 | 7,255 | 7,255 | 7,143 |
| Mol %: | | | | | |
| $CH_4$ | 57.41 | 0 | 94.83 | 94.83 | 97.10 |
| $CO_2$ | 0.49 | 0 | 0.82 | 0.82 | 0.05 |

TABLE 4-continued

| | Stream No. | | | | |
|---|---|---|---|---|---|
| | 151 | 156 | 157 | 159 | 161 |
| CO | 0.002 | 0 | 0.004 | 0.004 | 0.0001 |
| $H_2$ | 1.99 | 0 | 3.28 | 3.28 | 0.19 |
| $H_2O$ | 39.85 | 100 | 0.66 | 0.66 | 2.24 |
| $N_2$ | 0.16 | 0 | 0.27 | 0.27 | 0.27 |
| Ar | 0.09 | 0 | 0.15 | 0.15 | 0.15 |

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present disclosure, other and further embodiments of the disclosure may be devised without departing from the basic scope thereof, and the scope thereof is determined by the claims that follow.

What is claimed is:

1. A method for producing synthetic natural gas, comprising:

separating a syngas into a first syngas, a second syngas, and a third syngas;

methanating the first syngas to produce a first effluent;

mixing the first effluent with the second syngas to produce a first mixed effluent;

methanating the first mixed effluent to produce a second effluent;

mixing the second effluent with the third syngas to produce a second mixed effluent;

methanating the second mixed effluent to produce a third effluent;

recycling a first portion of the third effluent to the first syngas;

cooling a second portion of the third effluent to produce a first cooled effluent; and methanating the first cooled effluent to produce a synthetic natural gas.

2. The method of claim 1, further comprising transferring heat from at least one of the third effluent and the synthetic natural gas to the syngas to produce a heated syngas.

3. The method of claim 1, further comprising transferring heat from the synthetic natural gas to the syngas to produce a first heated syngas and transferring heat from the third effluent to the first heated syngas to produce a second heated syngas at a temperature of about 175° C. to about 300° C., wherein the second heated syngas is separated into the first syngas, the second syngas, and the third syngas.

4. The method of claim 1, wherein the first portion of the third effluent recycled to the first syngas ranges from about 10% to about 90% of the total amount of third effluent.

5. The method of claim 1, further comprising:

heating a heat transfer medium to a first temperature by transferring heat from the synthetic natural gas to produce a first heated heat transfer medium; and heating the first heated heat transfer medium by transferring heat from the first portion of the third effluent to produce a second heated heat transfer medium.

6. The method of claim 5, further comprising:

separating the second heated heat transfer medium to provide a first heat recovery medium, a second heat recovery medium, and a third heat recovery medium;

transferring heat from the first effluent to the first heat recovery medium to produce a heated first heat recovery medium;

transferring heat from the second effluent to the second heat recovery medium to produce a heated second heat recovery medium; and transferring heat from the third effluent to the third heat recovery medium to produce a heated third heat recovery medium.

7. The method of claim 6, wherein the heat transfer medium is boiler feed water and wherein the heated first heat recovery medium, the second heated heat recovery medium, and the third heated heat recovery medium comprise saturated steam.

8. A method for producing synthetic natural gas, comprising:

heating a syngas to produce a first heated syngas;

heating the first heated syngas to produce a second heated syngas;

separating the second heated syngas into a first syngas, a second syngas, and a third syngas;

methanating the first syngas to produce a first effluent comprising methane;

cooling the first effluent to produce a cooled first effluent;

combining the second syngas with the cooled first effluent to produce a first mixture;

methanating the first mixture to produce a second effluent comprising methane;

cooling the second effluent to produce a cooled second effluent;

combining the third syngas with the cooled second effluent to produce a second mixture;

methanating the second mixture to produce a third effluent comprising methane;

cooling the third effluent to produce a first cooled third effluent;

cooling a first portion of the first cooled third effluent by transferring heat from the first portion of the first cooled third effluent to the first heated syngas to produce a second cooled third effluent and the second heated syngas;

recycling a second portion of the first cooled third effluent to the first syngas prior to methanating the first syngas; and methanating the second cooled third effluent to produce a fourth effluent comprising methane, wherein the first heated syngas is produced by transferring heat from the fourth effluent to the syngas.

9. The method of claim 8, further comprising:

heating a heat transfer medium by transferring heat from the fourth effluent prior to transferring heat from the fourth effluent to the syngas to produce a first heated heat transfer medium; and heating the first heated heat transfer medium by transferring heat from the second portion of the first cooled third effluent prior to combing the second portion of the first cooled third effluent with the first syngas to produce a second heated heat transfer medium.

10. The method of claim 9, wherein the second heated heat transfer medium is separated into a first heat recovery medium, a second heat recovery medium, and a third heat recovery medium, and wherein the cooled first effluent is produced by transferring heat from the first heat recovery medium, the cooled second effluent is produced by transferring heat from the second heat recovery medium, and the cooled third effluent is produced by transferring heat from the third heat recovery medium.

11. The method of claim 10, wherein the heat transfer medium comprises boiler feed water, wherein transferring heat from the first, second, and third effluents produces a heated first heat recovery medium, a heated second heat recovery medium, and a heated third heat recovery medium that each comprise saturated steam, and wherein a concentration of saturated steam in the heated first heat recovery medium, the heated second heat recovery medium, and the heated third heat recovery medium ranges from about 5 wt % to about 95 wt %.

12. The method of claim 8, further comprising separating at least a portion of any water present in the second cooled third effluent to produce a first dried effluent, wherein the first dried effluent is methanated to produce the fourth effluent.

13. The method of claim 12, further comprising:

separating at least a portion of any water from the fourth effluent after transferring heat from the fourth effluent to the syngas to produce a second dried effluent; and compressing the second dried effluent to produce a compressed effluent, wherein the compressed effluent comprises about 90 mol % or more methane.

14. The method of claim 8, wherein fourth effluent has a methane concentration, on a dry basis, of about 97 mol % or more.

15. The method of claim 8, wherein the first syngas, the first mixture, and the second mixture undergo methanation at a temperature of about 350° C. to about 450° C., and the second cooled third effluent undergoes methanation at a temperature of about 250° C. to about 330° C.

16. The method of claim 8, wherein the first syngas, the first mixture, and the second mixture are methanated in the presence of a first catalyst, a second catalyst, and a third catalyst, respectively, wherein the second cooled third effluent is methanated in the presence of a fourth catalyst, and wherein the first, second, and third catalysts are different from the fourth catalyst.

17. The method of claim 5, wherein the heat being transferred is all indirect heat transfer.

* * * * *